United States Patent [19]

Small

[11] 4,285,520

[45] Aug. 25, 1981

[54] MASS CIRCULATION PUBLICATION BINGO TYPE GAME

[76] Inventor: Maynard E. Small, 105 Ward Pkwy., Apt. #507, Kansas City, Mo. 64112

[21] Appl. No.: 79,189

[22] Filed: Sep. 26, 1979

[51] Int. Cl.[3] ..... A63F 3/06

[52] U.S. Cl. ..... 273/240; 273/269; 273/286

[58] Field of Search ..... 273/240, 269, 287, 286

[56] References Cited

U.S. PATENT DOCUMENTS

| | | | |
|---|---|---|---|
| 2,124,136 | 7/1938 | Bugg | 273/269 X |
| 2,484,143 | 10/1949 | Arnold | 273/269 |
| 3,534,963 | 10/1970 | Weimer . | |
| 3,603,592 | 9/1971 | Bury . | |
| 3,941,388 | 3/1976 | Isaac et al. | 273/287 |
| 3,998,465 | 12/1976 | Mascola . | |

FOREIGN PATENT DOCUMENTS

| | | | |
|---|---|---|---|
| 872703 | 7/1961 | United Kingdom | 273/269 |

OTHER PUBLICATIONS

"Product Picture Game," Detroit Times Newspaper, Jun. 9, 1955, p. 40.

Playing Card entitled "Play Loblaws Check-Out Game," earliest U.S. copyright 1937.

Flyer entitled "National Product, Check-Out Game", copyright 1966.

*Primary Examiner*—Anton O. Oechsle

*Attorney, Agent, or Firm*—Fishburn, Gold & Litman

[57] ABSTRACT

A game for a plurality of players wherein each player is provided with a playing card that is common to all, said playing card being presented to the players by means of a mass distribution publication. The playing card comprises a matrix of delineated areas, such as squares, in rows and columns, each square bearing a certain indicia which is to be matched with a corresponding indicia found in a plurality of promotional coupons present in the same publication. The player matches such indicia and continues to do so until he has satisfied any one of several particular combinations of matched indicia. The player also may be any one of several required to ascertain the correct total number of coupons having appropriate indicia that appear in the publication in order to win the game or become eligible to progress toward winning a prize.

10 Claims, 4 Drawing Figures

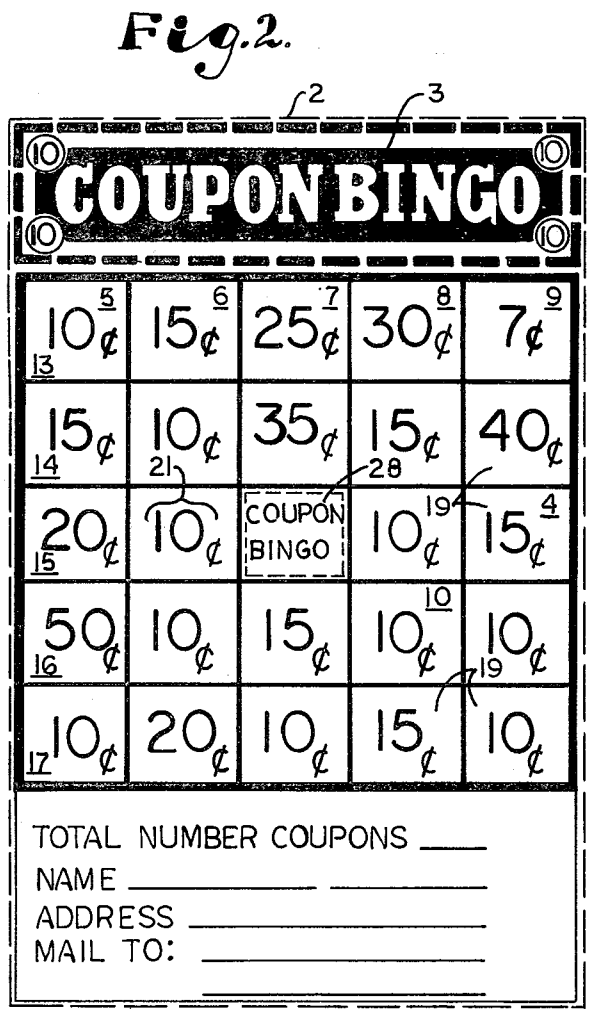
Fig. 2.
2
3
COUPON BINGO
COUPON BINGO
10¢ 5 13
15¢ 6
25¢ 7
30¢ 8
7¢ 9
15¢ 14
10¢ 21
35¢ 28
40¢
20¢ 15
10¢
COUPON BINGO
10¢ 19
15¢ 4
50¢ 16
10¢
15¢ 10
10¢ 19
10¢
10¢ 17
20¢
10¢
15¢
10¢
TOTAL NUMBER COUPONS
NAME
ADDRESS
MAIL TO:

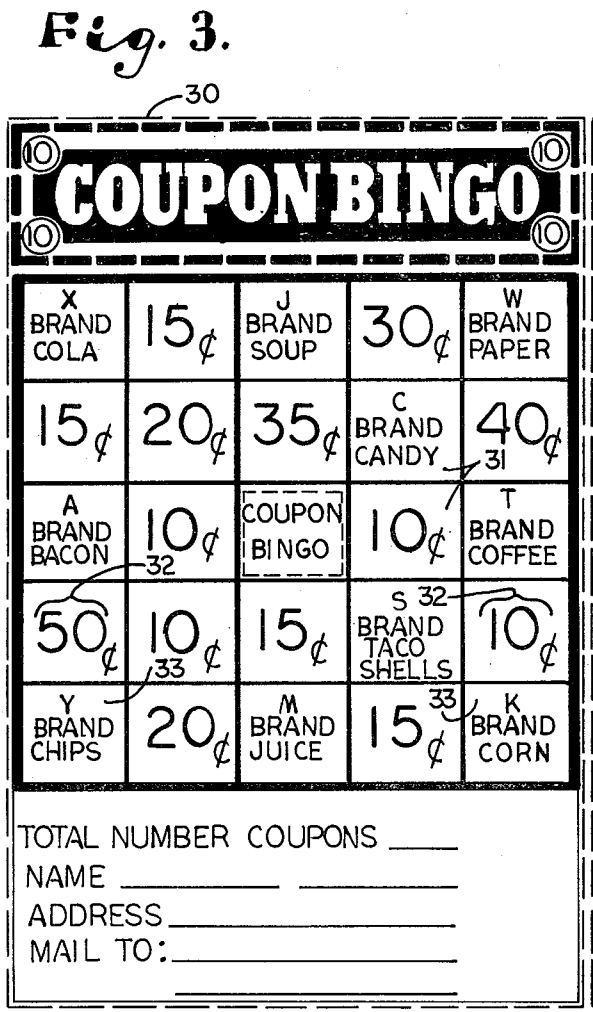
Fig. 3.
30
COUPON BINGO
COUPON BINGO
X BRAND COLA
15¢
J BRAND SOUP
30¢
W BRAND PAPER
15¢
20¢
35¢
C BRAND CANDY 31
40¢
A BRAND BACON 32
10¢
COUPON BINGO
10¢
T BRAND COFFEE
50¢
10¢ 33
15¢
S 32 BRAND TACO SHELLS
10¢
Y BRAND CHIPS
20¢
M BRAND JUICE
15¢ 33
K BRAND CORN
TOTAL NUMBER COUPONS
NAME
ADDRESS
MAIL TO:

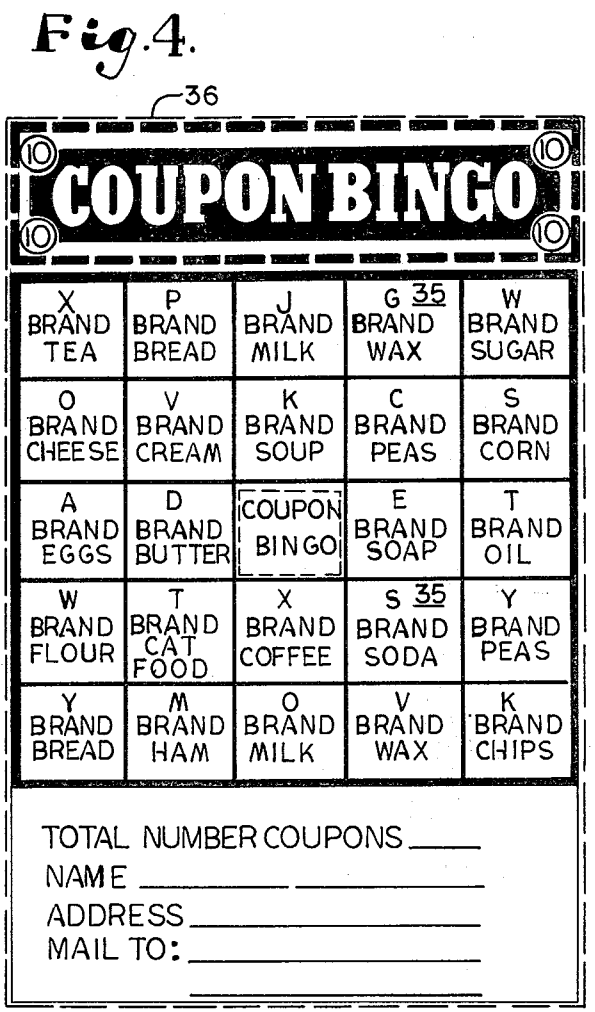
Fig. 4.
36
COUPON BINGO
COUPON BINGO
X BRAND TEA
P BRAND BREAD
J BRAND MILK
G 35 BRAND WAX
W BRAND SUGAR
O BRAND CHEESE
V BRAND CREAM
K BRAND SOUP
C BRAND PEAS
S BRAND CORN
A BRAND EGGS
D BRAND BUTTER
COUPON BINGO
E BRAND SOAP
T BRAND OIL
W BRAND FLOUR
T BRAND CAT FOOD
X BRAND COFFEE
S 35 BRAND SODA
Y BRAND PEAS
Y BRAND BREAD
M BRAND HAM
O BRAND MILK
V BRAND WAX
K BRAND CHIPS
TOTAL NUMBER COUPONS
NAME
ADDRESS
MAIL TO:

MASS CIRCULATION PUBLICATION BINGO TYPE GAME

SUMMARY OF THE INVENTION

This invention relates to game apparatus and, more particularly to game devices which require the use of a game board or card in matching certain given indicia with corresponding indicia found or supplied separately from the game board.

The game apparatus contemplated by this invention comprises a game board or card which is supplied to the players through a mass distribution, multi-page publication, such as a newspaper or magazine. In its presently preferred form, the board or card is printed "ROP" (run of press), rather than constituting a separate insert placed between the pages of the publication, however, the insert type of playing card, or other card delivery system might be used, if desired. Each playing card for a particular game is identical. The card is divided into a matrix of delineated areas, such as squares, with each square having a certain indicia therein corresponding to indicia found in the same publication. As presently intended, the latter indicia will be in, or associated with, a plurality of devices, such as promotional coupons, for example, the well known tear out or cut out "cents off" coupons used to encourage the retail sales of consumer items, typically including packaged food, cosmetics and household maintenance aids. For example, the indicia may be the "cents off" amount, a pictorial depiction of a product, or the name of a product manufacturer. It is contemplated that the coupon-associated indicia which corresponds to the card indicia, will be found in several separated locations within the publication, thus requiring the player to search out and examine a substantial number of coupons throughout the publication, thereby increasing the player's awareness of the existence and availability of many coupons which otherwise may be overlooked.

The player matches the indicia in selected areas or squares on the game card with the appropriate corresponding coupon indicia and continues to match and indicate same on the game card until a particular combination of matched indicia on the card has been obtained, producing a win. The combination of displayed indicia on the game card is carefully precoordinated with the coupon indicia throughout the publication so that the level of difficulty and challenge desired is presented to the player.

An alternative or additional embodiment would also require that the player provide the total number of coupons appearing in the publication and correctly identify this number on the playing card to produce a win. In one preferred form, the completed playing card is returned to the publisher, or its agent, where the card is validated as a win so as to make the player eligible for a prize or other desirable reward, such as entry to a random drawing for a prize. In the alternative, the validation may take place after the drawing to determine specific player eligibility for receiving the prize or reward.

OBJECTS OF THE INVENTION

The principal objects of the present invention are: to provide novel game apparatus utilizing indicial coordination between promotional coupons and game boards in mass distribution publications; to provide such game apparatus involving a cooperative relationship between indicia associated with multiple coupons spread throughout a publication and a game board forming a part of that same publication; to provide a bingo-type card game device which utilizes, as playing pieces, promotional coupons in a publication; to provide such a game structure capable of ROP presentation to members of the playing public; to provide a mass distribution, multi-page publication comprising a self contained combination of cooperating bingo-type board and game-playing indicial members; and to provide such a game structure which is appropriate for inexpensive mass distribution, versatile and well adapted for the proposed use thereof.

Other objects and advantages of this invention will become apparent from the following description taken in connection with the accompanying drawings, wherein are set forth by way of illustration and example certain embodiments of this invention.

The drawings constitute a part of this specification and include exemplary embodiments of the present invention and illustrate various objects and features thereof.

BRIEF DESCRIPTION OF THE DRAWINGS

FIG. 2 is a detailed plan view of the playing card of FIG. 1.

FIG. 3 is a plan view similar to FIG. 2 illustrating a second embodiment of this invention wherein the playing card indicia includes a mixture of product identities and "cents off" values in coupons found in the publication.

FIG. 4 is a plan view similar to FIG. 2 illustrating a third embodiment of this invention wherein the playing card indicia entirely consists of product identities associated with coupons found in the publication.

DETAILED DESCRIPTION OF THE PREFERRED EMBODIMENTS

Figure 1:
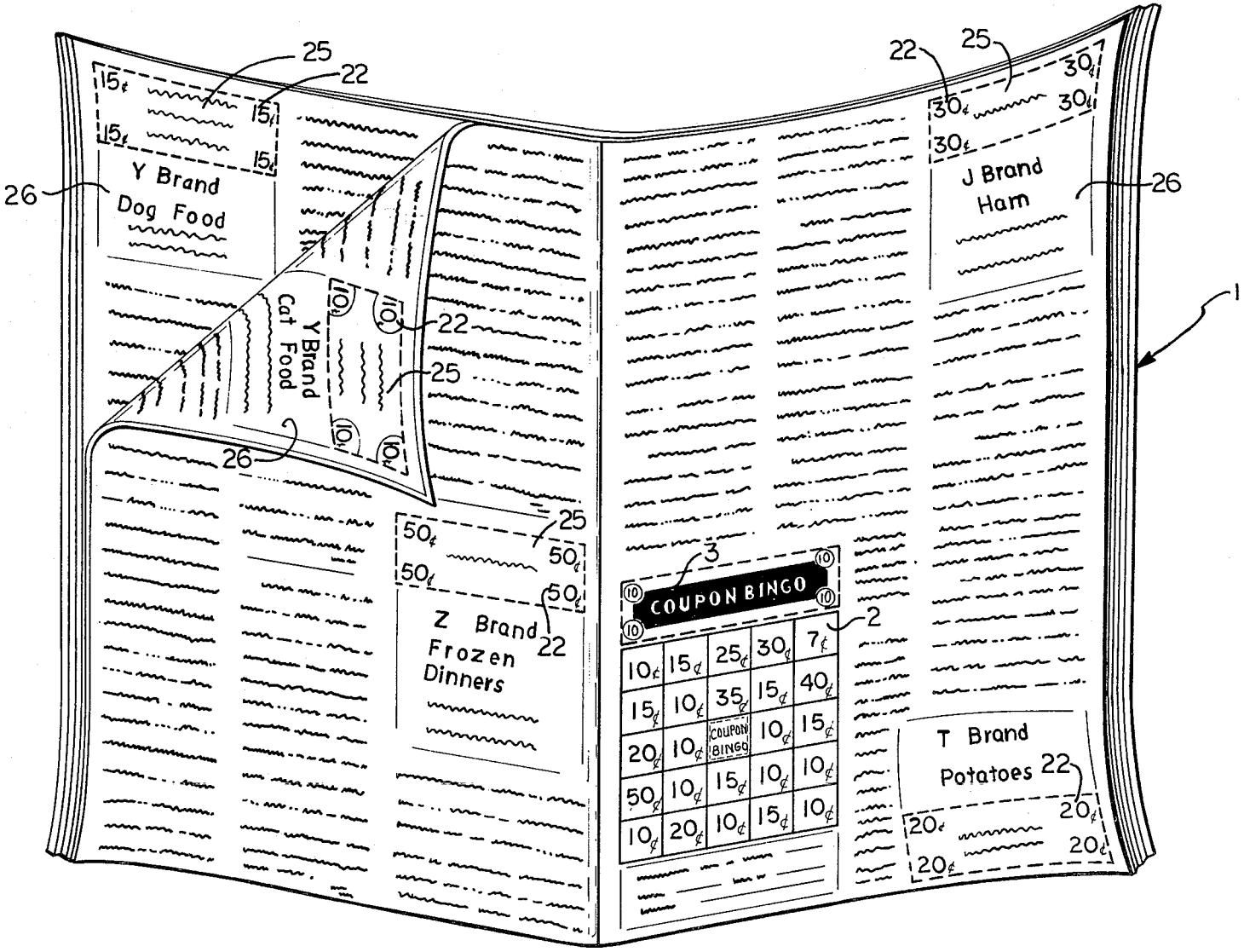
FIG. 1 is a perspective view showing a typical mass distribution newspaper having therein a playing card and associated playing pieces in the form of "cents off" coupons, according to one form of the present invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings, the reference numeral 1 generally designates a mass publication, in this example a typical daily newspaper, however any suitable printed and widely distributed document of the type which carries advertising would be appropriate. Illustrated in the publication 1 is a game board or playing card 2 which is printed "ROP" or "Run Of Press", meaning, in this embodiment, no special arrangements are made for inclusion, such as would be the case if a separate insert were used. Thus, the distribution of the board or card can be as inexpensive as other common printed matter carried by the publication. The particular position of the card 2 within the publication is not of great importance, so long as it is sufficiently prominent to arrest the attention of a potential player of the game.

The card 2, in this example, comprises an identifying heading 3, such as "COUPON BINGO" and a body or matrix 4 which here is divided into vertical columns 5, 6, 7, 8 and 9 and horizontal rows 13, 14, 15, 16 and 17, the rows and columns defining a grid of areas or, in this case, squares 10. Typically contained in pre-selected squares 10 is certain indicia 21 that is matched with respective corresponding, pre-selected indicia found elsewhere in the publication, the relationship between the card indicia and the location and distribution of the indicia 22 in the publication providing a novel arrangement in game structure.

The indicia 21, in this example, correspond to one or more "cents off" values forming the indicia 22, the latter being placed on or in close association with promotional coupons 25, known as "cents off coupons" which, typically are redeemable by a consumer for a portion of the selling price of a product or products identified thereon and, commonly, in advertising text 26 adjacent thereto. The several coupons 25, respectively bearing various individual value indicia 22, are preferrably, distributed throughout the publication 1 in substantially greater number than the number of indicia 21 values and, taken together, the various value indicia 22 form a plurality of numerical values of predetermined frequency and amount. The indicia 21, located in the squares 19, are related to the indicia 22 so that at least one column 5–9, one row 13–17 or one diagonally aligned group of squares extending from corner to corner of the matrix 4, correspond to a group of values contained in the total values making up the indicia 22.

Thus, within the publication 1, cooperative means are provided in the form of the printed card 2 and the coupon 25, the latter being distributed in many locations throughout the publication and bearing various value indicia, and the former bearing a special and unique relationship to the coupon indicia whereby correspondance exists, but is not obvious, providing the challenge necessary to create gaming interest in a player. As seen in FIG. 1, the coupons 25 are randomly spaced throughout the publication so as to be spaced apart therein. As seen in FIG. 1 at least a portion of the coupons 25 are positioned at various isolated locations throughout the pages of the publication so as to be spaced apart from one another by printed subject matter unrelated thereto and at least a portion of the coupons 25 being located on pages separate from the playing card 2.

In playing the game a player, preferably, cuts out all of the coupons in the publication; however, another form of tabulation of the indicia 22 values may be used. The player then compares the various indicia 22 values to the respective indicia 21 values on the card 2, also found in the publication 1. When a match is found between an indicia 22 value and an indicia 21 value, that one indicia 21 value is noted on the card 2, as by circling the figure or figures in the appropriate square 19. By repeating this procedure, the player should eventually discover the predetermined correspondence between selected indicia 22 values and indicia 21, which produces a win, that is, a completed row, column or diagonal group as noted above.

For variation, if desired, the center area or square 19 in the matrix 4 (or one or more other squares, not shown) may be designated "free", as is done in certain "bingo" type games. Such a "free" square is designated by the reference numeral 28 in FIG. 2 and constitutes a square which need not be matched to an indicia 22 value for completing the center row 15, the center column 7 or the diagonally aligned groups.

Also, an added challenge may be provided in requiring that the player furnish, on the card 2, the correct total number of coupons appearing in the publication 1 and from which the win has been obtained.

FIG. 3 illustrates another embodiment of this invention wherein certain of the indicia 21 values of FIG. 2 are replaced by product identifications on the card 2. Thus, the indicia 31 on the card 30 is a mixture of numerical values 32 and product identifications 33. The game is played in the same manner as described above, however, the player need only locate a coupon referring to the corresponding product in a product square, rather than a numerical value on a coupon.

FIG. 4 illustrates a further embodiment which carries the structure of FIG. 3 another step, that is, where all the active (not "free") areas or squares 35 on the card 36 constitute product identities rather than numerical values.

The player may be instructed to send the played card to an appropriate reception center where, if the win is validated, the player receives a prize or becomes eligible to win a prize.

Although the particular examples described above contemplate rows, columns or aligned groups to produce a win, additional combinations may also be used, such as matching the four corner squares, or other patterns. It is only necessary that the player be informed prior to beginning play, what arrangement or arrangements are required, the data (coupons) being previously arranged to produce a win with the desired degree of difficulty.

Also it should be realized that variations could utilize manufacturer's names instead of product identities and adaptations could be made for other printed device indicia, such as "buy one, get one free" coupons.

It is to be understood that while certain embodiments of the present invention have been illustrated and described, it is not to be limited to the specific forms or arrangement of parts described and shown herein, except insofar as such limitations are included in the following claims.

What is claimed and desired to secure by Letters Patent is:

1. A game of the type known as "bingo" for players comprising:

(a) a single edition of a printed run of press, multipage, and mass circulation publication;

(b) a playing card common to all players printed in said publication, said card having a grid with several rows and columns forming a set of oriented areas, each oriented area respectively bearing individual indicia whereby every player has a identical playing card having an identical set of oriented area indicia; and (c) a set of devices common to all players printed in said publication, at least a portion of said devices being positioned at various isolated locations throughout the pages of the publication as to be spaced apart from one another by printed subject matter unrelated thereto, each device respectively bearing individual indicia, whereby every player has an identical set of indicia bearing devices; at least a portion of said devices being located on pages separate from said playing card;

(d) said area indicia and said device indicia being cooperatively related, in that selected device indicia from the device indicia set match with selected indicia from the area indicia set such that said matched area indicia describes a predetermined pattern on said playing card grid; whereby each player is urged to scan each page of said publication to determine the presence of said devices in order to determine said predetermined pattern.

2. The game structure as set forth in claim 1 wherein:

(a) said devices are "cents-off" product promotional coupons.

3. The game structure as set forth in claim 1 wherein:

(a) said areas are squares.

4. The game structure as set forth in claim 1 wherein:

(a) said indicia are monetary values.

5. The game structure as set forth in claim 1 wherein:

(a) said indicia are product identities.

6. The game structure as set forth in claim 1 wherein:

(a) said indicia are manufacturer's names.

7. The game structure as set forth in claim 1 wherein:

(a) said area indicia and said devices indicia are identities of products which are advertised in said publication.

8. The game structure as set forth in claim 1 wherein:

(a) said area indicia and said devices indicia comprise a combination of "cents-off" coupon values and identities of certain products which are advertised in said publication.

9. The game as set forth in claim 1 wherein:

(a) at least one area on said grid is designated as a free area such that it does not contain therein an area indicia for matching with a certain devices indicia.

10. The game structure as set forth in claim 1 wherein:

(a) said card and devices are printed "run of press".

* * * * *